United States Patent [19]

West

[11] Patent Number: 4,551,952

[45] Date of Patent: Nov. 12, 1985

[54] TIRE SIDE WALL CLEANER

[75] Inventor: James C. West, Galveston, Tex.

[73] Assignee: Joe Collis Cochrane, Galveston, Tex. ; a part interest

[21] Appl. No.: 502,605

[22] Filed: Jun. 9, 1983

[51] Int. Cl.[4] ..... B24B 19/00

[52] U.S. Cl. ..... 51/241 S; 51/241 B

[58] Field of Search ..... 51/241 R, 241 S, 241 B, 51/43, 90, 104, 106; 157/13; 156/116

[56] References Cited

U.S. PATENT DOCUMENTS

| | | | |
|---|---|---|---|
| 2,364,506 | 12/1944 | Berezny | 51/43 |
| 2,372,341 | 3/1945 | Shanley | 51/43 |
| 2,736,995 | 3/1956 | Richey | 51/43 |
| 2,810,238 | 10/1957 | Yoho et al. | 157/13 |
| 2,960,807 | 11/1960 | Barrett | 51/241 B |
| 3,218,208 | 11/1965 | Molen | 157/13 |
| 3,583,105 | 6/1971 | Popp | 51/104 |
| 3,769,123 | 10/1973 | Botts et al. | 156/116 |
| 3,910,228 | 10/1975 | Doll | 51/104 |
| 4,041,652 | 8/1977 | Graven et al. | 51/241 R |

*Primary Examiner*—Roscoe V. Parker
*Attorney, Agent, or Firm*—Harvey B. Jacobson

[57] ABSTRACT

A mount is provided and an elongated arm has one end thereof pivotally supported from the mount for swinging of the arm relative to the mount about an axis extending transversely of the one arm end. The mount includes structure for releasably supporting the mount from a wheel hub having a vehicle wheel mounted thereon and with the aforementioned axis substantially coinciding with the axis of rotation of the wheel hub. A support is carried by the other end of the arm and has tire side wall buffing structure supported therefrom for buffing the outer side wall of a tire mounted on the wheel. The arm is adjustable in length, the support mounts guide wheels for rollingly engaging the outer periphery of the vehicle wheel from which the tire is supported and the buffing structure includes a motor driven buffing wheel rotatable about an axis which generally parallels the longitudinal extent of the arm.

9 Claims, 4 Drawing Figures

TIRE SIDE WALL CLEANER

BACKGROUND OF THE INVENTION

Various forms of tire side wall cleaning devices and buffing structures heretofore have been provided, but few have been constructed in a manner whereby the tire side wall buffing structure may be mounted directly from the associated wheel hub. In addition, most tire side wall buffing structures are not readily adjustable as to the radius of curvature of the annular area of the tire side wall to be buffed and are further not adjustable as to the positioning of the annular side wall area to be buffed as spaced along the transverse curvature of the associated tire side wall. Accordingly, a need exists for a tire side wall buffing apparatus which may be mounted directly from the associated wheel hub, which may be adjusted according to the radius of curvature of the annular band area of the associated tire side wall which is to be buffed and which may be adjusted according to the angular positioning of the annular area of the side wall to be buffed along the transverse curvature of the tire side wall.

Examples of various forms of tire side wall buffing devices as well as other structures including some of the general structural and operational features of the instant invention are disclosed in U.S. Pat. Nos. 2,364,506, 2,372,341, 2,736.995, 2,960,807, 3,583,105 and 3,910,228;

BRIEF DESCRIPTION OF THE INVENTION

The tire side wall cleaner of the instant invention includes a mount which may be readily supported from the outer ends of the wheel mounting studs of a vehicle wheel hub and further includes an elongated arm having one end pivotally supported from the mount for angular displacement of the arm reative to the mount about an axis which substantially coincides with the axis of rotation of the corresponding wheel hub and is disposed transverse to the arm. The outer end of the arm includes motor driven buffing wheel structure journalled therefrom by which the outer surface of a tire supported from a wheel mounted on the wheel hub may be buffed. The arm is adjustable in length to accommodate tires of different sizes and adjustment structure is included whereby the depth of a tire buffing operation may be adjusted and the angle of the buffer structure relative to the tire side wall surface to be buffed may be adjusted.

The main object of this invention is to provide a tire side wall buffing apparatus constructed in a manner whereby the entire apparatus may be supported from a wheel hub upon which an associated wheel and the tire to be buffed are mounted.

Another object of this invention is to provide a tire side wall buffing structure including adjustment features whereby the buffing structure may accommodate different size tires.

Yet another object of this invention is to provide a tire side wall buffing structure which may be adjusted to limit the depth of a tire side wall buffing operation.

A further object of this invention is to provide a tire side wall buffing structure which may be adjusted to accommodate side wall zones to be buffed of different radial extents.

A final object of this invention to be specifically enumerated herein is to provide a tire side wall buffing structure in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
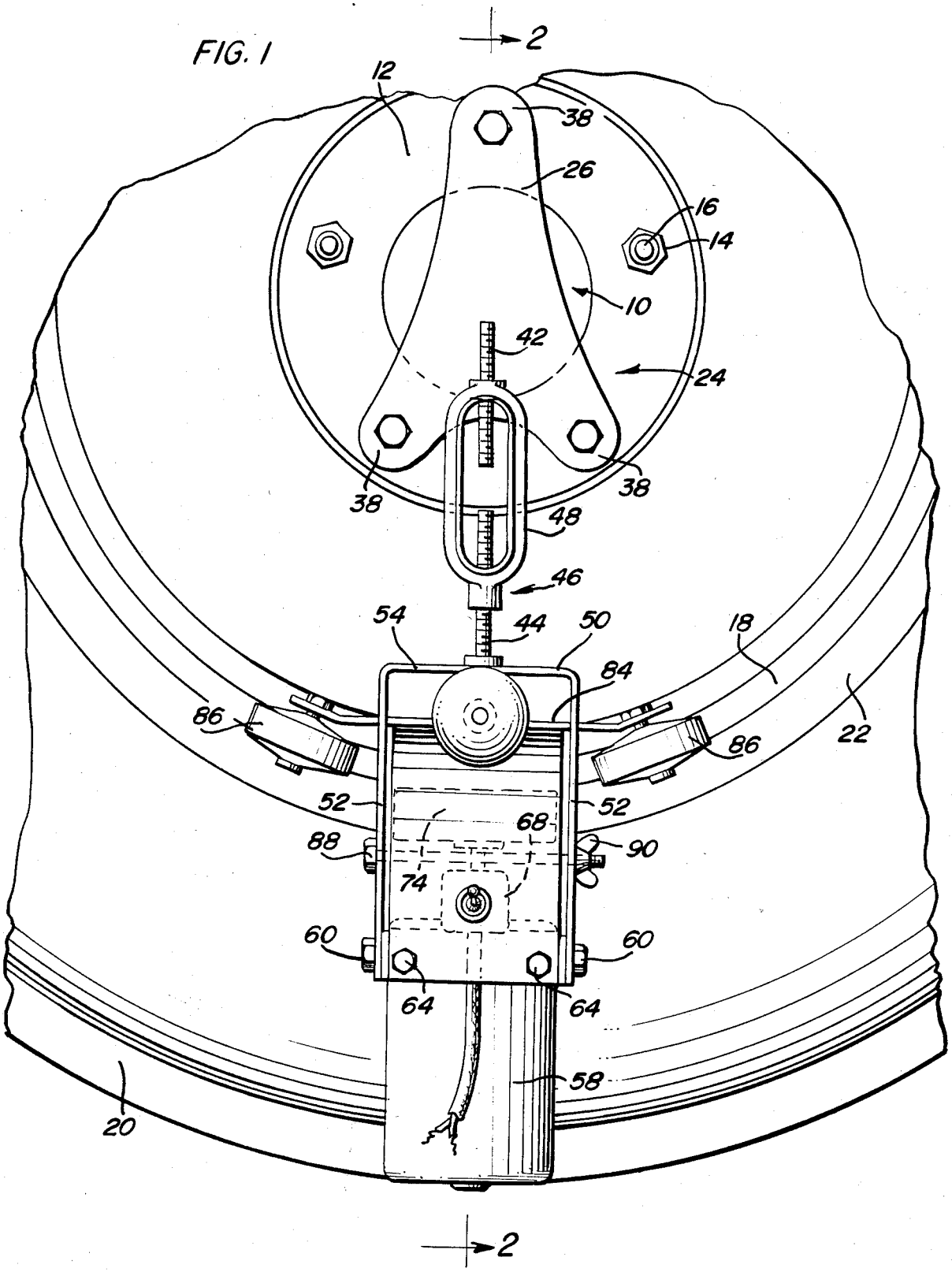
FIG. 1 is a fragmentary side elevational view of a rotary hub mounted vehicle wheel having a tire mounted thereon and with the tire side wall cleaner and/or buffer of the instant invention operatively mounted on three of the wheel studs carried by the rotatable hub.
Figure 2:
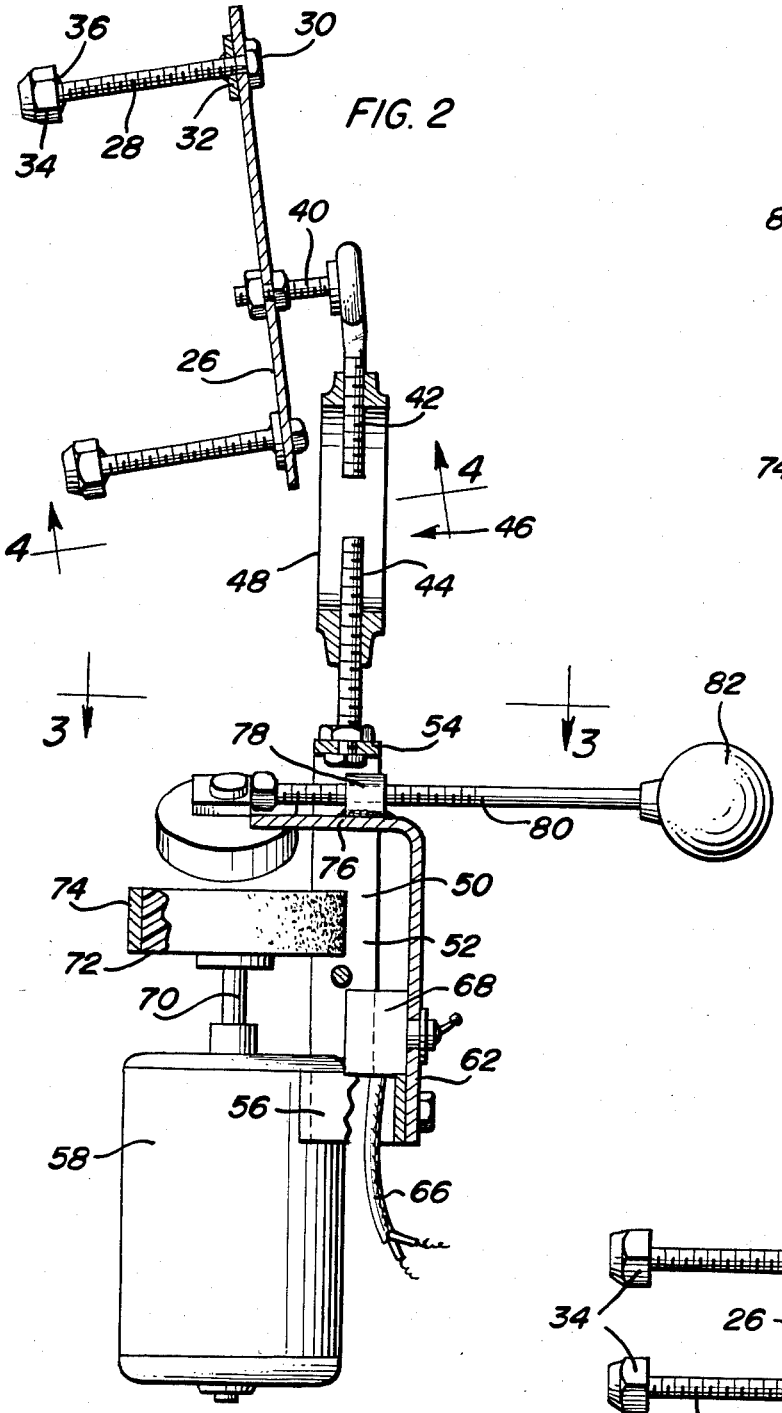
FIG. 2 is a sectional view taken substantially upon the plane indicated by the section line 2—2 of FIG. 1, but with the vehicle wheel hub, wheel and tire omitted.
Figure 3:
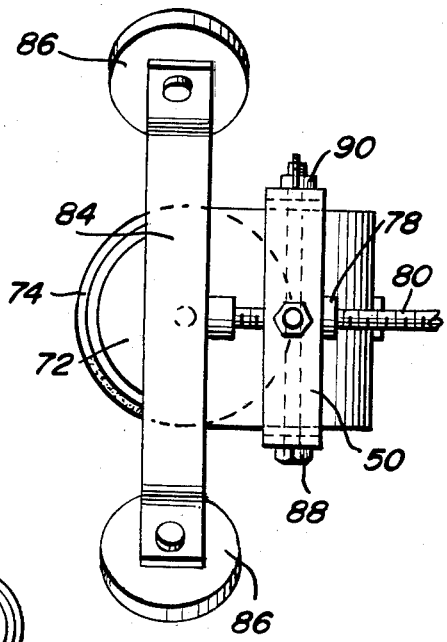
FIG. 3 is a vertical sectional view taken substantially upon the plane indicated by the section line 3—3 of FIG. 2.
Figure 4:
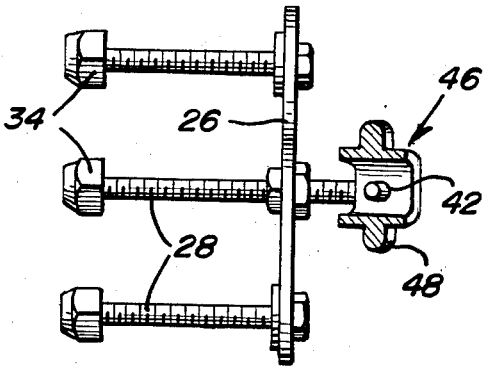
FIG. 4 is a vertical sectional view taken substantially upon the plane indicated by the section line 4—4 of FIG. 2

Referring now more specifically to the drawings the numeral 10 generally designates a rotatable wheel hub upon which a vehicle wheel 12 is mounted by the usual method of lug nuts 14 threaded over the extended ends of threaded studs 16 supported from the hub 10 and projecting through openings provided therefor in the wheel 12. The wheel 12 includes an outer flange portion 18 and a tire 20 is mounted on the wheel 18 and includes a narrow side wall portion 22 to be cleaned or buffed.

The tire side wall cleaner or buffer of the instant invention is referred to in general by the reference numeral 24 and includes a mounting plate 26 through which three bolts 28 are journalled. The bolts 28 are arranged in a triangular pattern and include hexagonal heads 30 and washers 32 secured thereon with the mounting plate 26 being received between the opposing surfaces of the heads 30 and washers 32. Lug nuts 34 are secured on the ends of the bolts 28 remote from the heads 30 in any convenient manner such as by welding 36 and the lug nuts 34 are threaded downwardly over the extended ends of the wheel mounting studs 16 which project beyond the lug nuts 14 disposed under the three apex portions 38 of the triangular mounting plate 26. In this manner, the mounting plate 26 may be stationarily supported from the rotatable hub.

The plate 26 includes a mounting stud 40 supported therefrom coaxial with the axis of rotation of the hub 10 and the outer end of the mounting stud 40 rotatably and universally supports the outer end of one of the reversely threaded shank portions 42 and 44 of a turnbuckle assembly referred to in general by the reference numeral 46 and including an adjusting nut assembly 48 threaded on the adjacent ends of the reversely threaded shank portions 42 and 44.

A U-shaped support bail 50 is provided and defines in combination with the assembly 46, support arm means angularly displaceable about the stud 40. The bail 50 includes a pair of generally parallel arms 52 interconnected at one pair of corresponding ends by a bight portion 54 extending therebetween. The intermediate length portion of the bight portion 54 is rotatably mounted on the end of the shank portion 44 remote from the shank portion 42 and motor mount portions 56 of an electric motor 58 are oscillatably supported from the free ends of the arms 52 by fasteners 60 rotatably received through the free ends of the arms 52 and threaded into the laterally spaced motor mount portions 56. The fasteners 60 are not fully tightened and thus allow frictionally resisted angular displacement of the motor 58 relative to the arms 52.

A mounting plate 62 bridges and is secured to the motor mounting portions 56 by suitable fasteners 64 and the electric motor 58 is electrically connected to a source (not shown) of electrical potential through an extension cord 66 under the control of an on-off switch 68 supported from the mounting plate 62. The electric motor 58 includes a rotatable output shaft 70 upon which a resilient wheel 72 is mounted and the resilient wheel 72 is faced by a replaceable buffing annulus 74 having a roughened outer surface.

The end of the mounting plate 62 remote from the motor mounting portions 56 includes a right angle portion 76 which supports a threaded nut portion 78 and an adjusting screw 80 provided with a knob 82 on one end is threaded through the nut portion 78 and rotatably supports a guide wheel bracket 84 from its end remote from the knob 82. The guide wheel bracket 84 includes opposite end portions from which guide rollers 86 are journalled and the guide rollers 86 are angled relative to each other for rolling engagement with the outer flange portion 18 of the wheel 12. In addition, the midportions of the arms 52 have aligned bores formed therethrough and a clamp screw 88 equipped with a thumb nut 90 is secured through the aligned bores. The thumb nut 90 may be tightened in order to frictionally retain the motor 58 in adjusted angularly displaced position relative to the bracket 50.

In operation, the mounting plate 26 is mounted on the extended outer end portions of three of the mounting studs 16 carried by the hub 10 over the outer side of the wheel 12. Of course, if the hub 10 includes four, six or eight mounting studs it will be necessary to provide a different pattern of the bolts 28 rotatably supported from the mounting plate 26. After the mounting plate 26 has been mounted, the turnbuckle 46 is adjusted to space the wheel 72 the proper distance from the center axis of the mounting stud 40 in order that the wheel 72 and annulus 74 may be properly aligned with the portion 22 of the side wall of the tire 20 to be buffed. Thereafter, the angulation of the electric motor 18 relative to the bracket 50 is adjusted and the adjustment of the motor 58 is maintained by tightening the thumb nut 90. Then, the electric motor 58 may be started and the adjusting screw 80 may be turned in order to adjust the outer periphery of the wheel 72 into contact with the zone or area 22 of the tire 20 to be buffed and the turnbuckle assembly 46 may then be slowly rotated about the mounting shank 40 until the entire area or side wall portion 22 has been buffed. Of course, if the radial extent of the area 22 is greater than the axial extent of the wheel 72, a second pass around the tire 20 must be made after the turnbuckle assembly 46 has been adjusted to space the wheel 72 a different radial distance from the mounting shank 40.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A tire side wall cleaner-buffer including a mount provided with support means for support of said mount from a vehicle wheel having a tire mounted thereon, elongated arm means, connecting means mounting one end of said arm means from said mount for angular displacement relative thereto about an axis extending transverse to said arm means and for at least limited angular displacement of said arm means relative to said mount about an axis transverse to said arm means and the first-mentioned axis, rotary abrasive wheel means journalled from the other end of said arm means for rotation about an axis generally parallelling said arm means, said arm means including adjustment means for adjusting the effective length of said arm means intermediate said connecting means and rotary abrasive wheel means.

2. The cleaner-buffer of claim 1 including support means supporting said rotary abrasive wheel means from the other end of said arm means for angular adjustment about an axis transverse to the longitudinal extent of said arm means.

3. The cleaner-buffer of claim 2 wherein said support means includes means operative to releasably retain said rotary abrasive wheel means in adjusted angular position relative to said arm means.

4. The cleaner-buffer of claim 1 wherein said arm means, intermediate said adjustment means and said other end of said arm means, includes guide means for guidingly engaging the outer peripheral portion of an associated wheel.

5. The cleaner-buffer of claim 4 wherein said guide means includes means for adjustably shifting said guide means laterally of the longitudinal extent of said arm means.

6. The cleaner-buffer of claim 5 including support means supporting said rotary abrasive wheel means from the other end of said arm means for angular adjustment about an axis transverse to the longitudinal extent of said arm means.

7. The cleaner-buffer of claim 6 wherein said support means includes means operative to releasably retain said rotary abrasive wheel means in adjusted angular position relative to said arm means.

8. The cleaner-buffer of claim 7 wherein said rotary abrasive wheel means includes an electrically driven motor.

9. The cleaner-buffer of claim 1 wherein said mount includes a mounting plate and said connecting means includes a laterally outwardly projecting stud carried by said plate and from whose outer end said one end of said arm means is pivotally supported, said plate including rotatable threaded socket means supported therefrom for threaded engagement over the extended end of threaded wheel mounting studs.

* * * * *